US006306458B1

(12) United States Patent
Mantkowski et al.

(10) Patent No.: US 6,306,458 B1
(45) Date of Patent: Oct. 23, 2001

(54) PROCESS FOR RECYCLING VAPOR PHASE ALUMINIDING DONOR ALLOY

(75) Inventors: Thomas E. Mantkowski, Madeira; Nripendra N. Das; Keith H. Betscher, both of West Chester; Raymond W. Heidorn, Fairfield; Jackie L. King, Franklin; Floyd A. Swigert, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/474,548

(22) Filed: Dec. 29, 1999

(51) Int. Cl.[7] ..... B32B 35/00

(52) U.S. Cl. ..... 427/140; 427/242; 427/250; 427/290; 427/309; 427/328; 427/347; 427/355; 427/367

(58) Field of Search ..... 427/140, 242, 427/250, 290, 309, 328, 347, 355, 367

(56) References Cited

U.S. PATENT DOCUMENTS

| | | | |
|---|---|---|---|
| 3,486,927 | | 12/1969 | Gauge . |
| 3,598,638 | | 8/1971 | Levine . |
| 3,951,642 | | 4/1976 | Chang et al. . |
| 3,961,910 | | 6/1976 | Baladjanian et al. . |
| 3,993,454 | | 11/1976 | Giggins, Jr. et al. . |
| 5,704,823 | * | 1/1998 | Wittebrood . |
| 5,817,371 | | 10/1998 | Gupta et al. . |
| 5,897,966 | | 4/1999 | Grossklaus, Jr. et al. . |
| 6,020,075 | | 2/2000 | Gupta et al. . |
| 6,146,696 | | 11/2000 | Das et al. . |
| 6,168,874 | | 1/2001 | Gupta et al. . |
| 6,174,448 | | 1/2001 | Das et al. . |

* cited by examiner

*Primary Examiner*—Bernard Pianalto
(74) *Attorney, Agent, or Firm*—Andrew C. Hess; Gerry S. Gressel

(57) ABSTRACT

A process for reclaiming aluminum alloy donor from a vapor phase deposition process used to form a diffusion aluminide coating on a component, such as the high-temperature superalloy components of gas turbine engines. The process generally entails recycling a particulate aluminum alloy donor material that, as a result of having been used as the donor material for depositing a diffusion aluminide coating on an article by vapor phase deposition, particles of the donor material comprise an aluminum alloy core encased in an aluminum-depleted shell. The process generally entails tumbling the donor material in a manner that removes the aluminum-depleted shell, followed by sieving the donor material to remove shell fragments and undersized particles.

20 Claims, No Drawings

PROCESS FOR RECYCLING VAPOR PHASE ALUMINIDING DONOR ALLOY

FIELD OF THE INVENTION

The present invention relates to deposition processes and materials. More particularly, this invention relates to a process for reclaiming and recycling donor materials used to deposit aluminide coatings by vapor phase deposition.

BACKGROUND OF THE INVENTION

The operating environment within a gas turbine engine is both thermally and chemically hostile. While significant advances in high temperature alloys have been achieved through the formulation of iron, nickel and cobalt-base superalloys, improvements in the environmental properties of such alloys are often achieved at the expense of mechanical properties, and vice versa. Accordingly, components formed from superalloys whose chemistries are formulated to have optimum mechanical properties at high temperatures are often susceptible to environmental attack, especially if used in certain sections of a gas turbine engine, such as the turbine, combustor and augmentor. A common solution is to provide such components with a protective environmental coating that inhibits oxidation and hot corrosion.

Coating materials that have found wide use for this purpose include diffusion aluminide coatings, which are generally single-layer oxidation-resistant layers formed by diffusion processes, such as pack cementation or vapor phase deposition. Diffusion aluminiding processes generally entail reacting the surface of a component with an aluminum-containing gas composition to form two distinct zones, the outermost of which is an additive layer containing an environmentally-resistant intermetallic represented by MA1, where M is iron, nickel or cobalt, depending on the superalloy substrate material. Beneath the additive layer is a diffusion zone comprising various intermetallic and metastable phases that form during the coating reaction as a result of diffusional gradients and changes in elemental solubility in the local region of the substrate. During high temperature exposure in air, the MAl intermetallic forms a protective aluminum oxide (alumina) scale or layer that inhibits oxidation of the diffusion coating and the underlying substrate.

Vapor phase deposition processes used to form diffusion aluminide coatings (known as vapor phase aluminiding, or VPA) generally involve the use of an aluminum-rich source (donor) material composed of aluminum or an aluminum alloy that is mixed or bonded with a metal having a higher melting temperature. Primary examples for the higher melting constituent include chromium, cobalt and iron. The donor material is typically in particulate form, with particle sizes typically on the order of about five to twenty millimeters in diameter. The donor particles and a suitable halide salt activator, such as $NH_4F$, NaF, KF, $NH_4Cl$ or $AlF_3$, are then heated to a temperature that will vaporize the activator, which reacts with the donor material, thereby forming a volatile aluminum halide that reacts at the surface of the component to form the diffusion aluminide coating. The chromium, cobalt or iron constituent of the donor does not deposit on the component, but instead merely serves as an inert carrier or binder for the aluminum.

At the end of the coating process, an aluminum-depleted layer is present on the surfaces of the donor particles. Over multiple coating operations, this layer becomes an encapsulating shell composed predominantly of the high-temperature constituent of the donor, and inhibits further removal of aluminum from the donor particles. In the past, used donor material has been processed through a sieve sizing operation to remove the particle shells and undersized particles, permitting reuse of the donor material. However, shell removal is incomplete, with the result that the donor material does not perform as well as when new. As an example, the time required to deposit an aluminide coating of desired thickness is often significantly longer than would otherwise be expected. Accordingly, though a potential cost advantage exists, there are significant process limits to the use of aluminum alloy donor material reclaimed from vapor phase aluminiding processes.

From the above, it can be appreciated that it would be desirable if a process were available to improve the quality of aluminum alloy donor material reclaimed from vapor phase aluminiding processes, so that the consistency and uniformity of diffusion aluminide coating produced by the reclaimed donor material might also be improved.

BRIEF SUMMARY OF THE INVENTION

The present invention provides a process for reclaiming aluminum alloy donor from a vapor phase deposition process used to form a diffusion aluminide coating on a component, such as the high-temperature superalloy components of gas turbine engines. The process of this invention generally entails recycling a particulate aluminum alloy donor material, the particles of which have an aluminum alloy core encased in an aluminum-depleted shell as a result of the donor material having been used to deposit a diffusion aluminide coating on an article by vapor phase deposition. The process generally entails tumbling the donor material in a manner that removes the aluminum-depleted shell, followed by sieving the donor material to remove shell fragments and particles that are smaller than what is required for the vapor phase process.

According to the invention, the combination of tumbling and sieving the particulate donor material more fully removes the aluminum-depleted shell surrounding the donor particles, such that the particles are more nearly equivalent to the original condition of the particles. In a preferred embodiment, the donor material is tumbled with an abrasive media in order to scour the surfaces of the particles. The tumbling operation, its duration, the amount of abrasive media used, and the timing of when the abrasive media is added have together been shown to produce a recycled donor material that is functionally equivalent to its original condition. As a result, recycled donor material can now be reliably used to produce diffusion aluminide coatings of controlled and predictable thickness.

Other objects and advantages of this invention will be better appreciated from the following detailed description.

DETAILED DESCRIPTION OF THE INVENTION

The present invention provides for the reclaiming and recycling of particulate aluminum alloy donor material whose outer particle surfaces are depleted of aluminum as a result of being used as the aluminum source for a vapor phase aluminiding (VPA) process. While the benefits of the invention will be discussed in terms of VPA processes used to coat and repair superalloy components that operate at elevated temperatures, such as the low pressure and high pressure turbine blades, vanes, nozzles and compressor blades of gas turbine engines, it is foreseeable that donor materials of different compositions and employed in different coating processes could benefit from this invention.

The process of this invention is directed to VPA processes that use particulate aluminum alloy donor materials, and particularly donor materials of aluminum mixed or alloyed with one or more metals with a higher melting temperature, a principal example of which is chromium. A particularly suitable donor material is a CrAl alloy containing about 25 to 35 weight percent aluminum, more typically about 30 weight percent aluminum. Aluminum donor materials for VPA processes typically have a particle size of about 0.1 mm to about 4 mm, with a preferred size range being 1 to 4 mm. During the VPA process, the donor material and a suitable carrier or activator, such as an ammonium or alkali metal halide, are heated to about 1925 degrees Fahrenheit to about 2000 degrees Fahrenheit (about 1050 to about 1090 degrees Centigrade), causing the activator to volatilize and react with the aluminum constituent at the surfaces of the donor particles, forming an aluminum compound vapor that disperses, envelops and reacts with the surface of a component to be coated. The relative amounts of the activator and donor material can vary, as is known by those skilled in the art. The thickness of the resulting diffusion aluminide coating is preferably controlled within a relatively narrow range, preferably about 0.001 to about 0.003 inch (about 25 to 76 micrometers.

With multiple VPA coating operations, the surfaces of the donor particles become depleted of their aluminum constituent, causing an aluminum-depleted shell to develop that encapsulates a core that essentially has an untouched reservoir of aluminum. The shell is generally formed by the remaining constituents of the donor material, e.g., chromium of the preferred CrAl alloy, though possibly containing up to about 15 weight percent aluminum. In this condition, the shell is generally porous and friable. According to this invention, the original potency of the donor material can be substantially restored by removing this shell through a tumbling operation, followed by a sieving operation that preferably eliminates shell fragments and undersized particles.

A suitable tumbling operation can be performed in a commercial twin shell blender equipped with a fifty-five gallon drum that is rotated end over end. The tumbling step is performed for a duration of about two to about twelve hours, though more preferably for about four to about eight hours. In a preferred embodiment, an abrasive media is tumbled with the donor material. A variety of potential abrasive materials exist for this purpose, including alumina ($Al_2O_3$), silica ($SiO_2$), iron grit, etc. Also in the preferred embodiment, two different size distributions of the abrasive media are used. A preferred size distribution for the coarser media is about 0.25 to about 3 mm, while a preferred size distribution for the finer media is about 25 to about 65 micrometers. This combination of abrasive media is believed to be particularly effective as a result of the coarser media impacting and breaking up the shells, after which the finer media serves to polish and file recesses and pores on the particle surfaces. While the finer and coarser abrasive media may both be mixed with the donor material prior to tumbling, the finer abrasive media are preferably added later during the tumbling operation, i.e., after the tumbling operation has commenced and the coarser media has substantially separated the shells from the donor particles. In the preferred embodiment, the finer and coarser abrasive media are used in roughly equal amounts, each about 15 to about 35 weight percent of the donor material being processed. The finer abrasive media are preferably added about one to ten hours after the start of the tumbling process.

Following tumbling, the aluminum-depleted shells are separated from the aluminum-rich cores of the donor particles, so that sufficient aluminum is again readily available at the surfaces of the donor material particles. The donor material and the resulting shell fragments are then sieved through a suitable screen to remove the shell fragments and any undersized donor particles. A preferred minimum size is about 4 mm, though greater and smaller size limits are foreseeable. Following the sieving operation, the donor particles can be immediately reused in additional VPA coating cycles.

In practice, a used CrAl donor material was reclaimed by tumbling the donor material with an alumina powder composed of equal amounts of a coarse powder having a particle size distribution of about 0.25 to about 3 mm, and a finer powder having a particle size distribution of about 25 to about 65 micrometers. The tumbling operation was performed in a commercial twin shell blender equipped with a fifty-five gallon drum rotated end over end. The donor material was initially tumbled for about six hours with an amount of the coarser powder equal to about 25 weight percent of the donor material. The finer powder was then added in an amount of about 25 weight percent of the donor material, after which tumbling continued for about two additional hours. The processed donor material was then successfully used as the sole aluminum source material to produce high-activity platinum aluminide coatings on superalloy specimens using conventional VPA process conditions, an achievement which could not previously be accomplished with donor material recycled by the conventional sieving process.

While the invention has been described in terms of a preferred embodiment, it is apparent that other forms could be adopted by one skilled in the art. Therefore, the scope of the invention is to be limited only by the following claims.

What is claimed is:

1. A method for recycling a particulate aluminum alloy donor material that was used to deposit a diffusion aluminide coating on an article by vapor phase deposition, such that particles of the donor material comprise an aluminum alloy core encased in an aluminum-depleted shell, the method comprising the steps of:

tumbling the donor material to remove the aluminum-depleted shell, the tumbling step comprising tumbling an abrasive media with the donor material, the abrasive media comprising particulate material of two different size distributions, abrasive particles of a finer of the two different size distributions being introduced during tumbling after commencing the tumbling step with a coarser of the two different size distributions; and then sieving the donor material to separate shell fragments from the donor material.

2. A method according to claim 1, wherein the donor material consists essentially of a chromium-aluminum alloy.

3. A method according to claim 2, wherein the aluminum-depleted shell consists essentially of chromium and up to 15 weight percent aluminum.

4. A method according to claim 1, wherein the abrasive media of the finer and coarser size distributions are each used in an amount of about 15 to about 35 weight percent of the donor material during the tumbling step.

5. A method according to claim 4, wherein the abrasive media of the finer and coarser size distributions are used in roughly equal amounts.

6. A method according to claim 1, wherein the abrasive media of the finer and coarser size distributions are used in roughly equal amounts during the tumbling step.

7. A method according to claim 1, wherein the abrasive media is aluminum oxide powder.

8. A method according to claim 1, wherein the tumbling step is performed for a duration of about two to about twelve hours.

9. A method according to claim 1, further comprising the step of reusing the donor material after the sieving step to deposit a diffusion aluminide on a second article by vapor phase deposition.

10. A process comprising the steps of:

vapor phase depositing a diffusion aluminide on an article by heating the article, an activator and a particulate aluminum alloy donor material within an enclosure while the article is out of contact with the donor material, particles of the donor material being depleted of aluminum at surfaces thereof during deposition such that each particle subsequently comprises an aluminum alloy core encased in an aluminum-depleted shell;

tumbling the donor material to remove the aluminum-depleted shell, the tumbling step comprising tumbling an abrasive media with the donor material, the abrasive media comprising particulate material of two different size distributions, a first size distribution having a size range that is larger than a second size distribution of the two different size distributions, the abrasive media having the second size distribution being introduced about one to about ten hours after commencing the tumbling step with the first size distribution;

sieving the donor material to remove shell fragments from the donor material; and then reusing the donor material to deposit a diffusion aluminide on a second article by heating the second article, an activator and the donor material within an enclosure while the article is out of contact with the donor material.

11. A method according to claim 10, wherein the donor material consists essentially of a chromium-aluminum alloy.

12. A method according to claim 11, wherein the aluminum-depleted shell consists essentially of chromium and up to 15 weight percent aluminum.

13. A method according to claim 12, wherein the abrasive media is tumbled with the donor material for a duration of about two to about twelve hours.

14. A method according to claim 13, wherein the first size distribution has a size range of about 0.25 to about 3 mm, and the second size distribution has a size range of about 25 to about 65 $\mu$m.

15. A method according to claim 14, wherein the abrasive media is aluminum oxide powder.

16. A method according to claim 14, wherein the abrasive media of the first and second size distributions are each used in an amount of about 15 to about 35 weight percent of the donor material during the tumbling step.

17. A method according to claim 10, wherein the tumbling step is performed for a duration of about two to about twelve hours.

18. A process comprising the steps of:

vapor phase depositing a diffusion aluminide on an article by heating the article, an activator and a particulate CrAl donor material within an enclosure while the article is out of contact with the donor material, particles of the donor material being depleted of aluminum at surfaces thereof during deposition such that each particle subsequently comprises a CrAl core encased in an aluminum-depleted shell consisting essentially of chromium and up to 15 weight percent aluminum;

tumbling the donor material for a duration of about two to about twelve hours to remove the aluminum-depleted shell, the tumbling step comprising tumbling a first abrasive media having a particle size distribution of about 0.25 to about 3 mm with the donor material for a duration of about two to about twelve hours, adding a second abrasive media having a particle size distribution of about 25 to about 65 $\mu$m to the donor material about one to about ten hours after commencing the tumbling step with the first abrasive material, and thereafter tumbling the first and second abrasive media with the donor material for the duration of the tumbling step;

sieving the donor material to remove shell fragments and particles smaller than 4 mm from the donor material; and then reusing the donor material to deposit a diffusion aluminide on a second article by heating the second article, an activator and the donor material within an enclosure while the article is out of contact with the donor material.

19. A method according to claim 18, wherein the first and second abrasive media are each used in an amount of about 15 to about 35 weight percent of the donor material during the tumbling step.

20. A method according to claim 19, wherein the first and second abrasive media are used in roughly equal amounts.

* * * * *